US009242458B2

(12) United States Patent
Nishitani et al.

(10) Patent No.: US 9,242,458 B2
(45) Date of Patent: Jan. 26, 2016

(54) INK JET RECORDING APPARATUS

(71) Applicant: CANON KABUSHIKI KAISHA, Tokyo (JP)

(72) Inventors: Eisuke Nishitani, Tokyo (JP); Koichiro Nakazawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/645,240

(22) Filed: Mar. 11, 2015

(65) Prior Publication Data

US 2015/0183215 A1 Jul. 2, 2015

Related U.S. Application Data

(63) Continuation of application No. 13/682,881, filed on Nov. 21, 2012, now Pat. No. 9,004,632.

(30) Foreign Application Priority Data

Nov. 29, 2011 (JP) ..... 2011-259932
Oct. 11, 2012 (JP) ..... 2012-225927

(51) Int. Cl.

| | |
|---|---|
| ***B41J 29/38*** | (2006.01) |
| ***B41J 2/045*** | (2006.01) |
| ***B41J 2/115*** | (2006.01) |
| ***B41J 2/155*** | (2006.01) |

(52) U.S. Cl.

CPC ..... *B41J 2/04543* (2013.01); *B41J 2/0458* (2013.01); *B41J 2/04505* (2013.01); *B41J 2/04585* (2013.01); *B41J 2/115* (2013.01); *B41J 2/155* (2013.01)

(58) Field of Classification Search

CPC .. B41J 2/04543; B41J 2/04505; B41J 2/0458; B41J 2/04585; B41J 2/155; B41J 2/158
USPC ..... 347/9, 10
See application file for complete search history.

(56) References Cited

U.S. PATENT DOCUMENTS

| | | | | |
|---|---|---|---|---|
| 5,006,864 | A * | 4/1991 | Ayata et al. | 346/33 R |
| 6,139,126 | A * | 10/2000 | Ayata et al. | 347/13 |
| 6,264,297 | B1 * | 7/2001 | Ayata et al. | 347/12 |
| 6,439,687 | B1 * | 8/2002 | Inoue | 347/41 |
| 6,460,976 | B1 * | 10/2002 | Oikawa | 347/57 |
| 2006/0012637 | A1 * | 1/2006 | Furukawa et al. | 347/55 |
| 2009/0002728 | A1 * | 1/2009 | Umezawa | 358/1.8 |
| 2011/0187775 | A1 * | 8/2011 | Masada et al. | 347/12 |

* cited by examiner

*Primary Examiner* — Stephen Meier
*Assistant Examiner* — Alexander D Shenderov
(74) *Attorney, Agent, or Firm* — Canon USA, Inc. IP Division

(57) ABSTRACT

An ink jet recording method for recording an image on a recording medium using a recording head includes executing relative movement between the recording medium and the recording head in a second direction intersecting a first direction in which a plurality of recording elements are arrayed. The recording head is controlled so that the plurality of recording elements in each group of respective driving blocks of recording elements are driven in order and at a predetermined time interval between respective driving blocks. A plurality of element arrays are driven so that pixels, based on recording data for one column extending in the first direction, are recorded by using the plurality of element arrays within an area of the recording medium corresponding to relative movement width of the relative movement in the second direction within the predetermined time interval.

20 Claims, 12 Drawing Sheets a1 or e1
b1
c1
d1
a1 or e1
b1
c1
d1
a1 or e1
b1
c1
d1

NOZZLE COLUMN A
NOZZLE COLUMN B
NOZZLE COLUMN C
A1
A2
B1
B2
C1
C2
L1
L2
GROUP 1
GROUP 2
GROUP 3
GROUP 4
102
103
104
2

105
106
d
a1 or c1
b1
b2
a2 or c2
a1
a2
b2 or c2
RECORDING ORDER
y
x

INK JET RECORDING APPARATUS

CROSS REFERENCE TO RELATED APPLICATIONS

The present application is a continuation of U.S. patent application Ser. No. 13/682,881, filed on Nov. 21, 2012, which claims priority from Japanese Patent Application No. 2011-259932, filed Nov. 29, 2011, and from Japanese Patent Application No. 2012-225927, filed Oct. 11, 2012, all of which are hereby incorporated by reference herein in their entirety.

BACKGROUND OF THE INVENTION

1. Field of the Invention

The present invention relates to an ink jet recording apparatus.

2. Description of the Related Art

In ink jet recording apparatuses, the number of recording elements in a recording head tends to increase to achieve higher resolution of a recorded image. In the ink jet recording apparatus that includes many recording elements, when all the recording elements are simultaneously driven, power consumption temporarily increases. Thus, the ink jet recording apparatus employs a block driving system for dividing each recording element into a plurality of blocks and driving the recording element by the blocks.

In the ink jet recording apparatus employing the block driving system, power consumption necessary for driving the recording elements can be made equal by shifting driving timings among the blocks. However, during recording, a positional relationship constantly changes between the recording head and a recording medium. Accordingly, when there is a difference in driving timing among the blocks, droplets discharged by blocks land on a recording medium in a shifted manner according to the difference. Thus, in the ink jet recording apparatus employing the block driving system, quality of an image formed on the recording medium may be reduced.

To solve such an issue, for example, Japanese Patent Application Laid-Open No. 2008-183742 discusses a method for counting the number of droplets (number of dots) to be discharged by each block based on recoded data, and changing a driving order so that a driving timing of a block having a large number of dots can be shorter.

A recent ink jet recording apparatus has been used for industrial and commercial printing. In these fields, throughput faster than a household ink jet recording apparatus is required.

In the ink jet recording apparatus designed to achieve high-speed throughput, moving speeds of the recording head and the recording medium relative to each other are higher. Even when the method discussed in Japanese Patent Application Laid-Open No. 2008-183742 is used, a length of the recording medium conveyed before completion of recording of one column is larger, consequently widening an area of one column on the recording medium. Thus, there is a possibility that image quality of a thin line or a character including the thin line formed in a recording direction or a direction vertical to the recording direction may be deteriorated.

SUMMARY OF THE INVENTION

The present invention is directed to an ink jet recording apparatus and an ink jet recording method that can suppress deterioration of recorded image quality while achieving high-speed throughput.

According to an aspect of the present invention, an ink jet recording method for recording an image on a recording medium using a recording head including a plurality of element arrays, wherein each element array includes a plurality of recording elements that are arrayed in a first direction and used for discharging ink for forming pixels on a recording medium, wherein the plurality of recording elements of each element array are divided into a plurality of groups where each group includes a plurality of recording elements being continuously arranged and assigned to different driving blocks for driving the recording elements, and wherein a number of the element arrays is equal to or larger than a number of recoding elements in a group, includes executing relative movement between the recording medium and the recording head in a second direction intersecting the first direction, and controlling the recording head so that the plurality of recording elements in each group of the respective driving blocks are driven in order and at a predetermined time interval between the respective driving blocks, wherein the plurality of element arrays are driven so that pixels, based on recording data for one column extending in the first direction, are recorded by using the plurality of element arrays within an area of the recording medium corresponding to relative movement width of the relative movement in the second direction within the predetermined time interval.

According to the present invention, an ink jet recording apparatus can be provided that can suppress deterioration of recorded image quality while achieving high-speed throughput.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

According to the present invention, an ink jet recording apparatus and a method are provided which can suppress deterioration of recorded image quality by eliminating, in principle, impact shifting of droplets on a recording medium caused by a difference in driving timings among blocks in a block driving system. The impact shifting does not include any of the followings: impact shifting caused by variation in a discharge speed or a discharge direction due to manufacturing tolerance of droplet discharge nozzles, impact shifting caused by variation in a distance between a recording head and a recording medium, and impact shifting caused by uneven conveyance of a recording medium.

Herein, "recording" includes not only a case of generating significant information such as a character or a graphic but also a case of forming an image, a design, or a pattern on a recording medium or processing the recording medium.

"Recording medium" includes not only paper used in a general recording device but also cloth, a plastic film, a metal plate, glass, ceramics, lumber, leather, or the like on which an image can be recorded by ink.

"Ink" is liquid applied on a recording medium to form an image, a design, or a pattern, or used for processing of the recording medium, or ink processing. The ink processing includes, for example, solidification or insolubilization of a coloring material in the ink applied to a recording medium.

Figure 1:
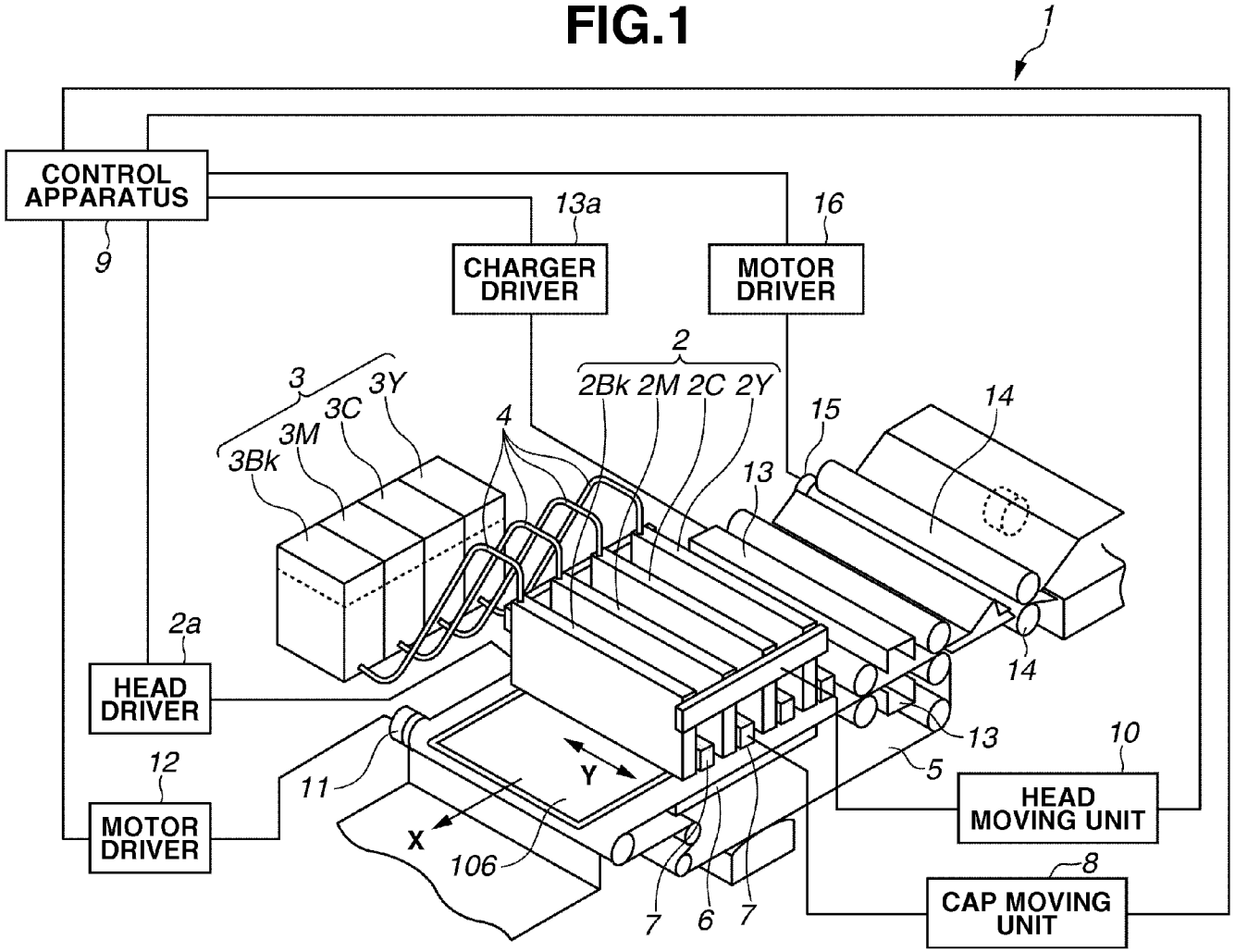
FIG. 1 is a schematic view of a configuration example of an ink jet recording apparatus.

FIG. 1 is a schematic view of a configuration example of an ink jet recording apparatus.

The inkjet recording apparatus 1 illustrated in FIG. 1 is, for example, a color inkjet recording apparatus of a line head type that includes a plurality of recording heads 2Y, 2M, 2C, and 2Bk arrayed in a conveyance direction (i.e., a main scanning direction) of a recording medium 106. The recording direction is the main scanning direction. The recording head 2Y discharges yellow ink, the recording head 2M discharges magenta ink, the recording head 2C discharges cyan ink, and the recording head 2Bk discharges black ink. The recording heads 2Y, 2M, 2C, and 2Bk have nearly identical configuration to one another. Thus, hereinafter, these recording heads will be collectively referred to as a recording head 2 except for a case where they are differentiated from one another.

Ink tanks 3Y, 3M, 3C and 3Bk (hereinafter, "ink tank 3" collectively) for storing yellow, magenta, cyan, and black inks are connected to the recording head 2 via a connection pipe 4. The ink tank 3 is connected to the connection pipe 4 to be replaceable by an operator of the ink jet recording apparatus 1. The recording head 2 is located to face a platen 6 across a conveyance belt 5 for conveying the recording medium 106, and movable toward the platen 6 by a head moving unit 10.

There is formed in the recording head 2 a plurality of nozzles that includes an ink discharge port for discharging ink, a common liquid chamber to which the ink stored in the ink tank 3 is supplied, and an ink flow path for guiding the ink from the common liquid chamber to each ink discharge port. A recording element for discharging the ink, such as an electrothermal transducer (heater) for generating thermal energy, is disposed in each ink flow path. The heater is connected to a control apparatus 9 via a head driver 2*a*. The control apparatus 9 controls supplying or stopping of power to the heater by transmitting an ON or OFF signal (discharge or non-discharge signal) to the head driver 2*a*.

Each recording head 2 includes a cap 7 used for recovery processing for recovering ink discharge performance by discharging viscosity-increased ink (waste ink) remaining in the ink flow path. The caps 7 are arranged in parallel on the sides of the recording heads 2 by being shifted half a pitch from, for example, an arrangement interval of the recording heads 2. During the recovery processing, the cap 7 is moved directly below the recording head 2 by a cap moving unit 8, and stopped at a position of covering an ink discharge surface. By setting negative pressure in the cap 7 by a recovery unit (not illustrated) in this state, the waste ink is sucked and discharged from the ink discharge port. The recovery processing is performed, for example, before a recording operation on the recording medium 106.

The conveyance belt 5 is an endless belt suspended on a driving roller connected to a belt driving motor 11. The conveyance belt 5 is rotated by driving the belt driving motor 11 by a motor driver 12 according to a control signal from the control apparatus 9, and thus the recording medium 106 placed on the conveyance belt 5 is conveyed in the main scanning direction. On an upstream side of the recording medium 106 in the conveyance direction, a charger 13 is disposed to firmly attach the recording medium 106 to the conveyance belt 5 by charging the conveyance belt 5. The charger 13 is energized by a charger driver 13*a* to charge the conveyance belt 5.

The recording medium 106 is fed onto the conveyance belt 5 by a pair of feeding rollers 14. The feeding roller 14 is connected to a feeding motor 15, and rotated by driving the feeding motor 15 by a motor driver 16 according to a control signal from the control apparatus 9.

The control apparatus 9 controls a recording operation of the ink jet recording apparatus 1 by transmitting a predetermined control signal to the head driver 2*a*, the motor drivers 12 and 16, the charger driver 13*a*, the head moving unit 10, and the cap moving unit 8.

The control apparatus 9 executes image processing for recorded data input from the outside. The image processing includes, for example, processing for quantizing the recorded data (multivalued image data) into N-value image data for each pixel, and generating a data signal for each pixel corresponding to a gradation value "K" of each quantized pixel. As a device for outputting multivalued image data, an image input device such as a scanner or a digital camera or an information processing device such as a stationary or portable computer may be used. For gradation processing (K value processing) of the multivalued image data, halftone representation such as a multivalued error diffusion method, an average density preservation method, a dither matrix method, or the like can be used. The control apparatus 9 generates, by repeating the K value processing for all the pixels based on density information of a recorded image, a binary data signal instructing ink discharging or non-discharging to be supplied to each recording element. The control apparatus 9 can be realized by an information processing apparatus (computer) including a central processing unit (CPU), a memory, and various logical circuits.

Figure 2:
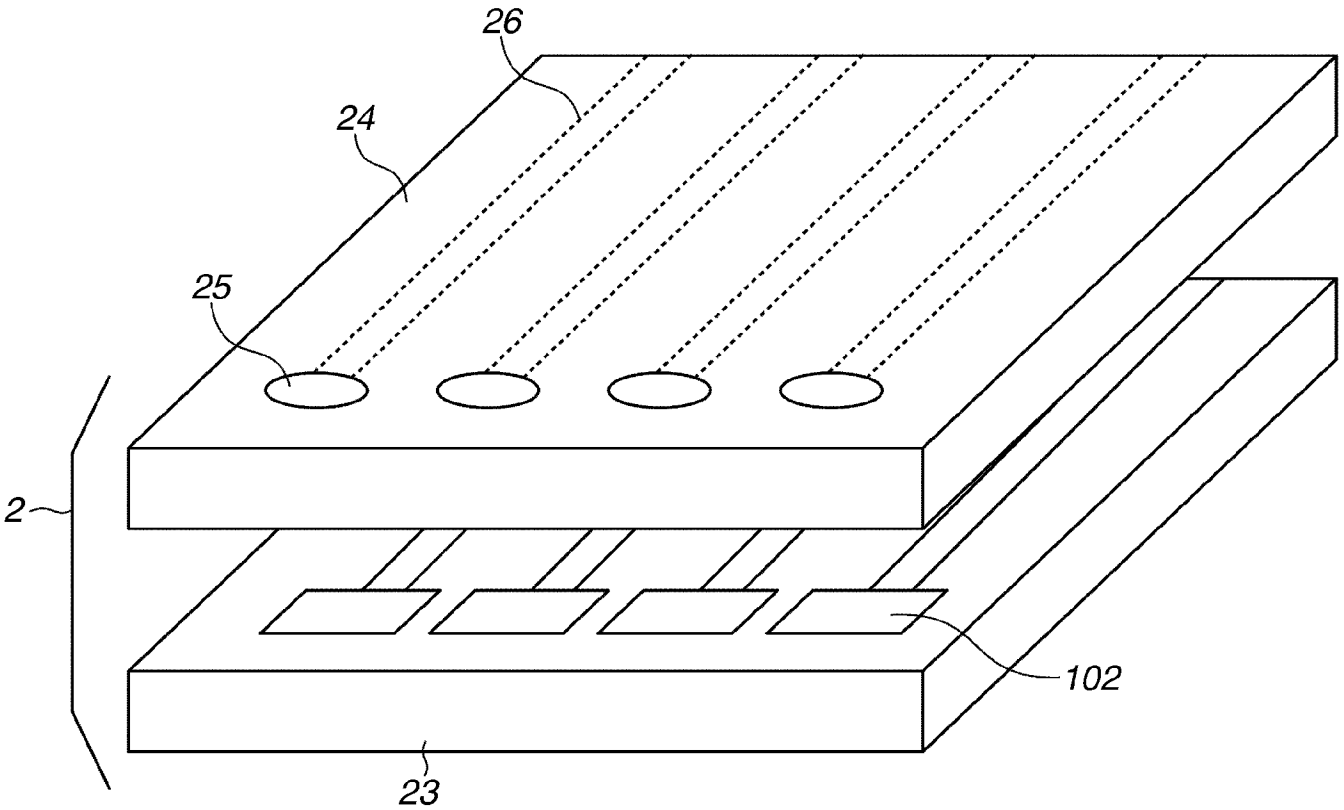
FIG. 2 is a schematic view of an internal structure example of a recording head illustrated in FIG. 1.

FIG. 2 is a schematic view of an internal structure example of the recording head illustrated in FIG. 1.

As illustrated in FIG. 2, the recording head 2 includes a substrate 23 on which a plurality of recording elements 102 for discharging the ink is formed, and a top board 24 mounted on the substrate 23. The top board 24 includes a plurality of ink discharge ports 25, and liquid paths 26 formed behind the ink discharge ports 25 to communicate therewith. The respective liquid paths 26 are commonly connected to one ink liquid chamber (not illustrated). The ink stored in the ink tank 3 is supplied to the ink liquid chamber via an ink supply port, and the ink in the ink liquid chamber is supplied to each liquid path 26.

The substrate 23 and the top board 24 are assembled by aligning their positions with each other so that one recording element 102 can be disposed in each liquid path 26. In the assembled recording head 2, when power is supplied in a pulse shape to the recording element 102, the ink on the recording element 102 is heated to generate bubbles in the liquid path 26. The bubbles then expand to discharge ink droplets from the ink discharge port 25.

In this configuration, when data is recorded to the recording medium 106, the control apparatus 9 first raises the recording head 2 from its standby position by the head moving unit 10 (moves the recording head 2 in a direction away from the platen 6). Then, the control apparatus 9 moves the cap 7 directly below each recording head 2 using the cap moving unit 8 to execute recovery processing using the cap 7.

After the end of the recovery processing, the control apparatus 9 moves the cap 7 to its original standby position using the cap moving unit 8, and lowers the recording head 2 to a predetermined recording position using the cap moving unit 8 (moves the recording head 2 in a direction closer to the platen 6).

Then, the control apparatus 9 charges the conveyance belt 5 by the charger 13 using the charger driver 13*a*, and rotates the conveyance belt 5 by the motor driver 12. Further, the control apparatus 9 rotates the feeding roller 14 by the motor driver 16, and mounts the recording medium 106 on the conveyance belt 5 by the feeding roller 14. Then, the control apparatus 9 drives each recording element (heater) included in the recording head 2 by the head driver 2*a* according to a data signal for each pixel to record a required image on the recording medium 106 conveyed on the conveyance belt 5.

Embodiments are suitable for a bubble-jet (registered trademark) system that uses a heating element (heater) in the recording element 102. Not limited to this system, however, embodiments can be applied to various types of ink jet recording apparatus. For example, in the case of a continuous ink jet recording apparatus that continuously ejects ink droplets to form particles, an embodiment can be applied to a charge control type or a dissipation control type ink jet recording apparatus. In the case of a drop-on-demand type that discharges ink droplets when necessary, an embodiment can be applied to an ink jet recording apparatus of a pressure control system that discharges ink droplets from the discharge ports by mechanical vibration of a piezoelectric oscillation element or the like.

Figure 6:
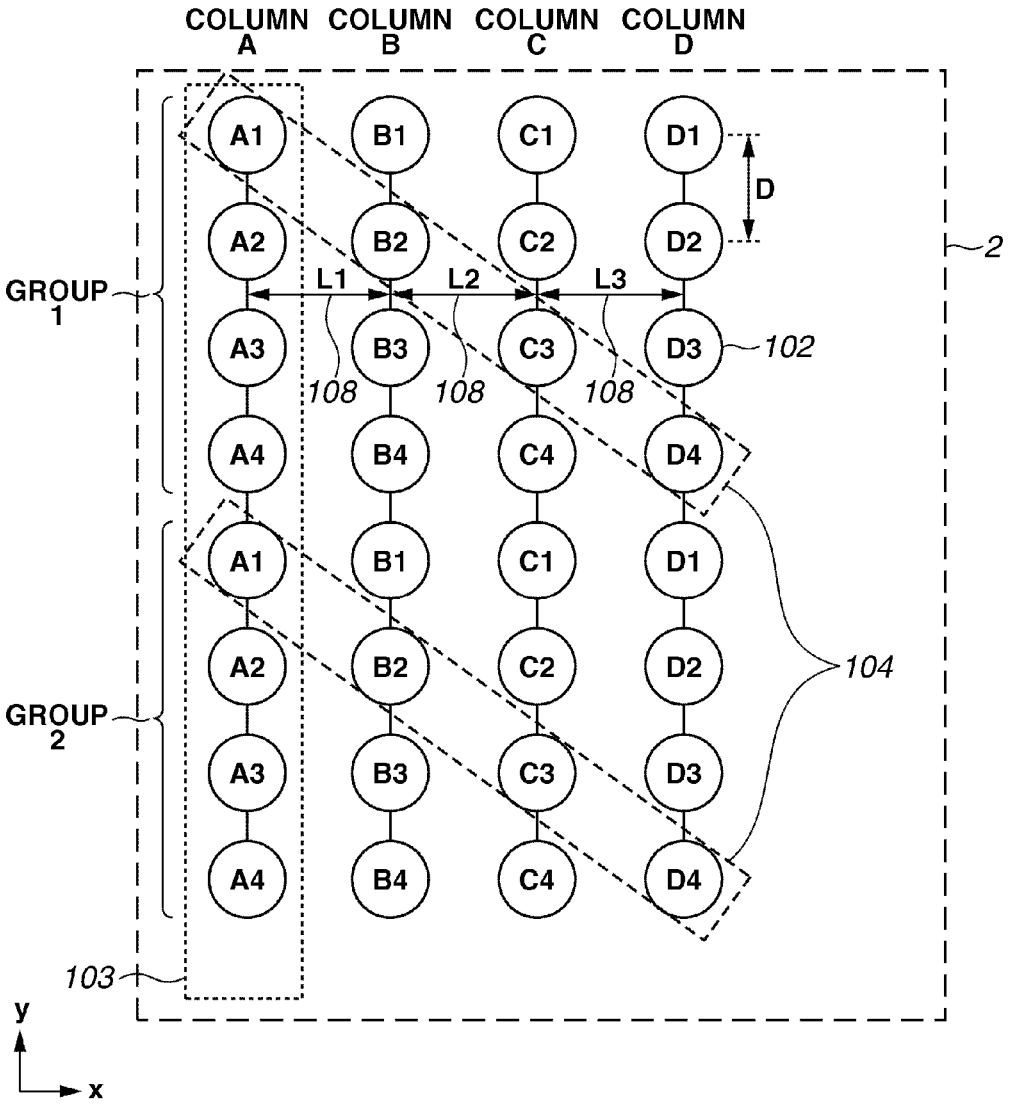
FIG. 6 is a schematic view of a recording head seen from an ink discharge port according to the first exemplary embodiment.

Next, referring to the drawings, an inkjet recording apparatus according to a first exemplary embodiment of the present invention will be described. FIG. 6 is a schematic view of one recording head seen from an ink discharge port side.

As illustrated in FIG. 6, the recording head 2 according to the present exemplary embodiment includes a plurality of nozzle columns 103 (four columns A to D in the example illustrated in FIG. 6) in which a plurality of recording elements 102 is linearly disposed (in-line). In each nozzle column 103, the plurality of recording elements 102 is arranged in a row at a specific interval D.

Each nozzle column 103 illustrated in FIG. 6 is divided into a plurality of groups including a plurality of continuous recording elements 102 (in this case, each group includes of four recording elements). Further, block numbers are assigned to the recording elements of each group in an arrangement order. More specifically, the recording elements 102 of the nozzle column A are respectively regarded as blocks A1 to A4, and the recording elements 102 of the nozzle column B are respectively regarded as blocks B1 to B4. Similarly, the recording elements 102 of the nozzle column C are respectively regarded as blocks C1 to C4, and the recording elements 102 of the nozzle column D are respectively regarded as blocks D1 to D4. During recording on the recording medium 106, the recording element 102 is driven by blocks of each nozzle column 103 in time division. In the recording head according to the presence exemplary embodiment, the number of recording elements 102 included is equal among the groups, and the number of recording elements (number of blocks) included in the group and the number of nozzle columns are equal to each other.

Figure 3:
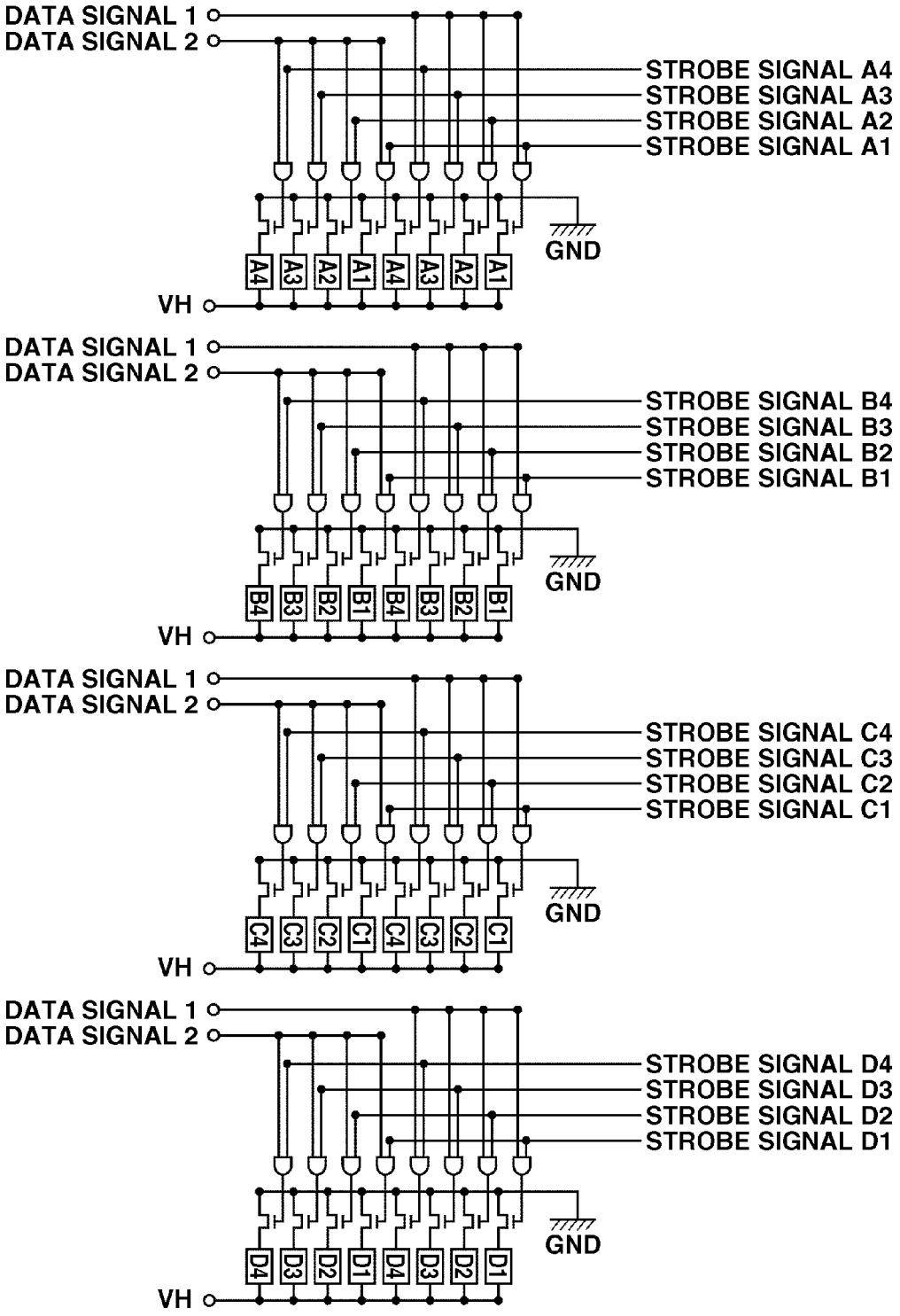
FIG. 3 is a circuit diagram of a configuration example of a head driver illustrated in FIG. 1.

FIG. 3 is a circuit diagram illustrating a configuration example of the head driver illustrated in FIG. 1. The head driver 2*a* illustrated in FIG. 3 is a circuit configuration example for driving the recording head 2 that includes the nozzle columns A to D illustrated in FIG. 6. FIG. 3 illustrates the blocks A1 to A4, B1 to B4, C1 to C4, and D1 to D4 of the respective recording elements 102 illustrated in FIG. 6.

As illustrated in FIG. 3, with respect to each recording element 102, a predetermined voltage VH is applied to one end thereof, and the other end is connected to a ground potential (GND) via a field effect transistor (FET). An output terminal of an AND gate is connected to an input terminal (gate electrode) of each FET. A data signal and a strobe signal transmitted from the control apparatus 9 are input to each AND gate. The data signal is generated based on the recorded data for instructing a corresponding recording element 102 to discharge or not discharge ink droplets. The strobe signal is used for determining a timing of permitting driving of each block or time of energization (allowing driving for each block).

When an image is recorded on the recording medium 106, the control apparatus 9 transmits a data signal corresponding to the image to be recorded. For example, the data signal is a binary signal set to a "High" level when the recording element 102 is driven to discharge ink droplets, and to a "Low" level when no ink droplet is discharged. In addition, the control apparatus 9 transmits strobe signals A1 to A4, B1 to B4, C1 to C4, and D1 to D4 corresponding to the blocks of the respective nozzle columns 103. When a result of a logical AND operation of the data signal and the strobe signal is a "High" level, power is supplied to a corresponding recording element 102 to generate heat, and ink droplets are discharged according to the heat generation.

The control apparatus 9 shifts transmission timings of the strobe signals corresponding to the respective blocks by a specific time interval. Thus, by controlling the transmission timings of the respective strobe signals, block driving (time-division driving) where each nozzle column is divided into four blocks as driving units is performed. By preventing simultaneous transmission of two or more strobe signals, power consumption necessary for driving the recording element may be uniform.

Figure 7:
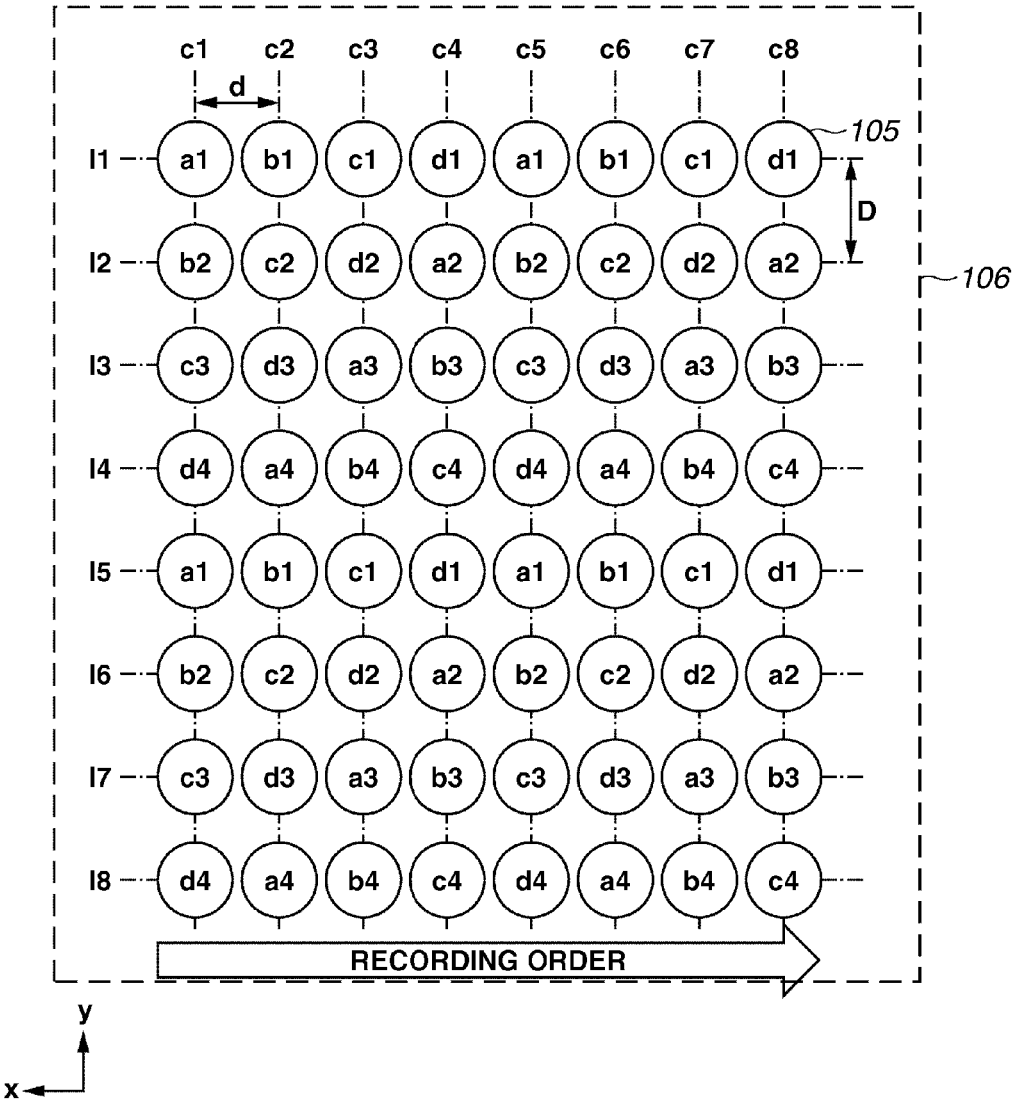
FIG. 7 is a schematic view of a pixel formed on a recording medium by the ink jet recording apparatus according to the first exemplary embodiment.

FIG. 7 illustrates a characteristic recording pattern, which are pixels formed on the recording medium using the recording head illustrated in FIG. 6. Circles of pixels a1 to a4, b1 to b4, c1 to c4, and d1 to d4 in FIG. 7 indicate pixels 105 formed on the recording medium 106 by ink droplets discharged from the recording elements 102 of the corresponding blocks A1 to A4, B1 to B4, C1 to C4, and D1 to D4 included in the recording head 2 in FIG. 6. Ideal forming positions of the pixels 105 on the recording medium 106 are indicated by raster numbers l1, l2, l3, . . . and column numbers c1, c2, c3, . . . An interval D is set between the pixels 105 in a nozzle arrangement direction because of the interval D between the nozzles. An image is printed so that an interval d can be set between the pixels 105 in a conveyance direction (raster direction) of the recording medium 106.

Printing an image in the pixel 105 in the nozzle arrangement direction (column direction) vertical to the moving direction of the recording medium 106 is controlled so that recorded data of one column can be substantially arrayed in one column using a plurality of nozzle columns. Through the control executed to print the image so that the recorded data of one column can be arrayed in one column, an area of one column on the recording medium can be widened to prevent reduction of quality of the image.

To match forming positions of pixels printed by different nozzle columns on the recording medium 106 with each other in the nozzle arrangement direction (column direction) of the recording medium 106, a driving timing between the nozzle columns is controlled in addition to driving timing control in the same nozzle column. In other words, to land dots to be recorded on the recording medium based on the recorded data of one column in a row in the nozzle arrangement direction, the driving timing between the plurality of nozzle columns is adjusted.

A driving timing control method for forming an image illustrated in FIG. 7 will be described.

(Driving Timing Control in the Same Nozzle Column)

First, referring to the drawings, the method for controlling a driving timing of each block in the same nozzle column in the case where dots are landed on positions illustrated in FIG. 7 will be described. In FIG. 7, the pixels printed from the respective nozzle columns are arranged in order at intervals d. For example, the pixels a1, a4, a3, and a2 are arranged in this order in the column A, the pixels b1, b4, b3, and b2 are arranged in this order in the column B, the pixels c1, c4, c3, and c2 are arranged in this order in the column C, and the pixels d1, d4, d3, and d2 are arranged in this order in the column D.

Such pixels can be recorded by transmitting strobe signals from the control apparatus 9 at specific intervals. More specifically, the control apparatus transmits, at specific intervals, strobe signals A1, A4, A3, and A2 in this order in the column A, strobe signals B1, B4, B3, and B2 in this order in the column B, strobe signals C1, C4, C3, and C2 in this order in the column C, and strobe signals D1, D4, D3, and D2 in this order in the column D. In other words, block driving orders are controlled to math one another in all the nozzle columns.

FIGS. 4A to 4D are timing charts illustrating an example of a driving timing of each block in the same nozzle column. It is presumed that a recording medium 106 is mounted on the conveyance belt 5 to be conveyed at a speed v in an x axis positive direction illustrated in FIG. 7.

Figure 4A:
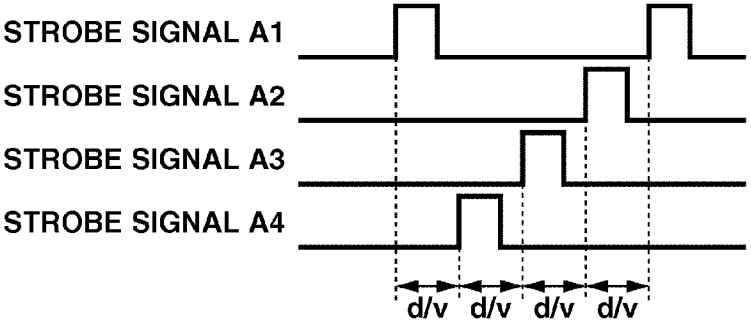
FIGS. 4A to 4D are timing charts of an example of a driving timing in each nozzle column according to a first exemplary embodiment.
Figure 4B:
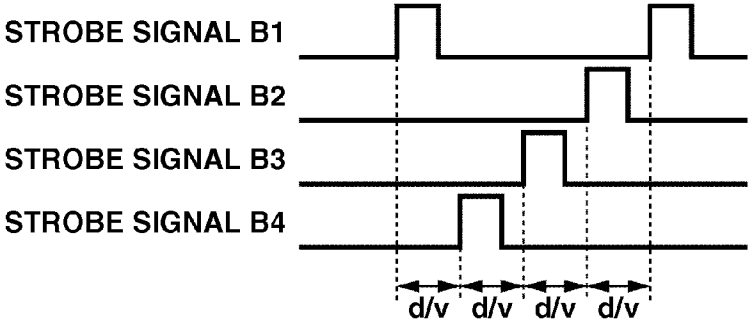
Figure 4C:
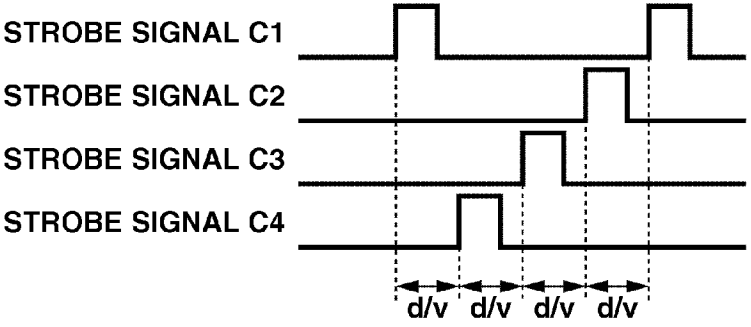
Figure 4D:
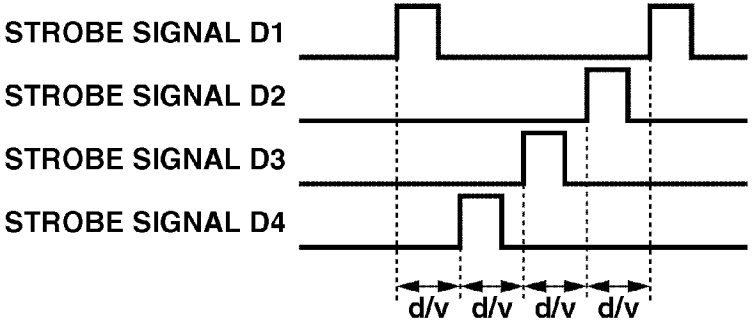

FIG. 4A illustrates driving timings of the blocks A1 to A4 of the recording element included in the nozzle column A, and FIG. 4B illustrates driving timings of the blocks B1 to B4 of the recording element included in the nozzle column B. FIG. 4C illustrates driving timings of the blocks C1 to C4 of the recording element included in the nozzle column C, and FIG. 4D illustrates driving timings of the blocks D1 to D4 of the recording element included in the nozzle column D. As illustrated in FIGS. 4A to 4D, the driving timings of the recording elements 102 of the respective blocks are controlled based on the strobe signals A1 to A4, B1 to B4, C1 to C4, and D1 to D4 corresponding to the respective blocks.

For example, when each recording element 102 of the nozzle column A is driven, as illustrated in FIG. 4A, the control apparatus 9 first transmits the strobe signal A1 permitting driving of the block A1. At this time, in the nozzle column A, ink droplets are discharged from the recording element 102 of a data signal of a "High" level in the block A1. The ink droplets discharged from the block A1 form a pixel a1 on the recording medium 106 illustrated in FIG. 7. It is presumed that the data signals A1 to A4 and HE-A signals are all set to "High" levels.

A strobe signal A4 for permitting driving of the block A4 is transmitted being delayed by predetermined time t14 from the transmission time of the strobe signal A1. To land the ink droplets discharged from the block A4 away from the impact position of the ink droplets of the block A1 illustrated in FIG. 7 by a distance d in the raster direction, the recording medium 106 is moved by d. In other words, the predetermined time t14 may be set to a value d/v.

A strobe signal A3 for permitting driving of the block A3 is transmitted being delayed by predetermined time t43 from the transmission time of the strobe signal A4. The predetermined time t43 may be set to a value d/v as in the above-described case.

A strobe signal A2 for permitting driving of the block A2 is transmitted being delayed by predetermined time t32 from the transmission time of the strobe signal A3. The predetermined time t32 may be set to a value d/v as in the above-described case. Further, a strobe signal A for permitting re-driving of the block A1 is transmitted being delayed by predetermined time t21 from the transmission time of the strobe signal A3 for permitting driving of the block A3. The predetermined time t21 may be set to a value d/v as in the above-described case.

For the nozzle columns B to D, as illustrated in FIGS. 4B to 4D, as in the case of the nozzle column A, the recording elements 102 of the respective blocks are driven by using the strobe signals B1 to B4, C1 to C4, and D1 to D4. In other words, in the same nozzle column, the recording elements 102 of the respective blocks are sequentially driven at the specific time interval of d/v (time-division driving).

As described above, by allowing sequential driving of the respective blocks in the same nozzle column at the specific time interval (d/v), four pixels 105 can be formed at specific intervals d in the moving direction (raster direction) of the recording medium 106.

(Driving Timing Control Between Nozzle Columns)

Next, referring to the drawings, the method for controlling driving timings between the nozzle columns to match the forming positions of pixels printed by different nozzle columns with one another in the nozzle arrangement direction (column direction) of the recording medium 106 will be described. FIG. 6 illustrates a distance L1 between the nozzle column A and the nozzle column B, a distance L2 between the nozzle column B and the nozzle column C, and a distance L3 between the nozzle column C and the nozzle column D.

Figure 5:
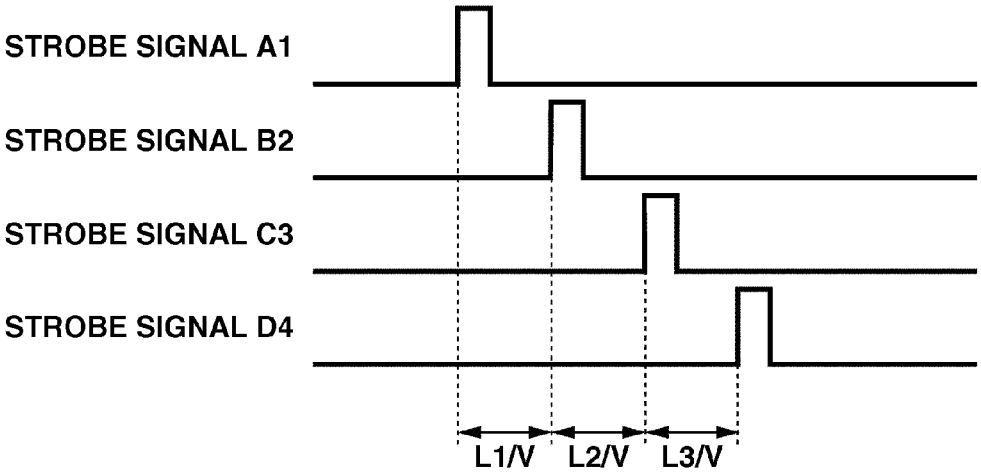
FIG. 5 is a timing chart of an example of driving timings to match impact positions with one another in a column direction according to the first exemplary embodiment.

FIG. 5 is a timing chart illustrating an example of driving timings between the nozzle columns. FIG. 5 illustrates a relationship of driving timings in a group 104 including blocks A1, B2, C3, and D4 when pixels matched with one another in the column direction are formed.

First, to match the positions of the pixels a1 and b2 with each other in the column direction in the column number c1 illustrated in FIG. 7, the recording medium 106 is moved by the distance L1 after the pixel a1 is printed. In other words, the strobe signal B2 for permitting driving of the block B2 is transmitted with the passage of time tAB=L1/v from the transmission time of the strobe signal A1.

Further, to match the positions of the pixels a1, b2 and c3 with one another in the column direction, the recording medium 106 is moved by the distance L2 after the pixel b2 is printed. That is, the strobe signal C3 for permitting driving of the block C3 is to be transmitted with the passage of time tBC=L2/v from the transmission time of the strobe signal B2. In other words, the strobe signal C3 is transmitted being delayed from the transmission time of the strobe signal A1 by tAB+tBC=(L1+L2)/2.

Further, to match the positions of the pixels a1, b2, c3 and d4 with one another in the column direction, the recording medium 106 is moved by the distance L3 after the pixel c3 is printed. That is, the strobe signal D4 for permitting driving of the block D4 is transmitted with the passage of time tCD=L3/v from the transmission time of the strobe signal C3. In other words, the strobe signal D4 is transmitted being delayed from the transmission time of the strobe signal A1 by tAB+tBC+tCD=(L1+L2+L3)/2.

When transmission time of the strobe signal A1 is zero and intervals between the nozzle columns are uniform (L1=L2=L3=L), transmission time of the strobe signal B1 is represented by L/v, transmission time of the strobe signal C1 is represented by 2L/v, and transmission time of the strobe signal D1 is represented by 3L/v.

For the pixels b1, c2, d3, and a4 of the column number C2, the pixels c1, d2, a3, and b4 of the column number C3, and the pixels d1, a2, b3, and c4 of the column number C4, as in the case of the column number C1, transmission timings of the strobe signals are driven to match positions in the column direction.

As described above, the number of nozzle columns is set equal to that of recording elements (number of blocks) included in the group, and the recording elements are driven by a time difference based on the distance between the nozzle columns and the conveyance speed of the recording medium. Thus, each of pixels 105 can be formed so that the positions are matched with one another in the column direction of the recording medium 106.

Thus, by forming the pixels so that the positions can be matched with one another in the column direction, impact shifting of ink droplets on the recording medium 106 caused by a driving timing difference between the blocks in the block driving system can be eliminated in principle. Accordingly, deterioration of recorded image quality caused by the driving timing difference between the blocks can be suppressed. Especially, by employing the present exemplary embodiment, deterioration of the recorded image quality can be suppressed even if the moving speed v of the recording medium 106 is high.

The present exemplary embodiment is described byway of example where the pixels are formed to match one another in position in the column direction. However, the similar effect can be provided even by executing control to set impact positions of ink droplets discharged by recorded data of one column within a width d that is a conveyance width of the recording medium conveyed at one interval of time division.

The present exemplary embodiment is described byway of case where the time-division driving orders are similar among the nozzle columns. However, time division driving can be performed in a manner that driving orders are different among the nozzle columns. In this case, by controlling the driving timing by considering the distance of the recording medium conveyed at one interval of the time division in addition to the distance between the nozzle columns, control is executed so that positions of the ink droplets discharged by the recorded data of one column can match one another in the column direction.

Next, an ink jet recording apparatus according to a second exemplary embodiment will be described.

Figure 8:
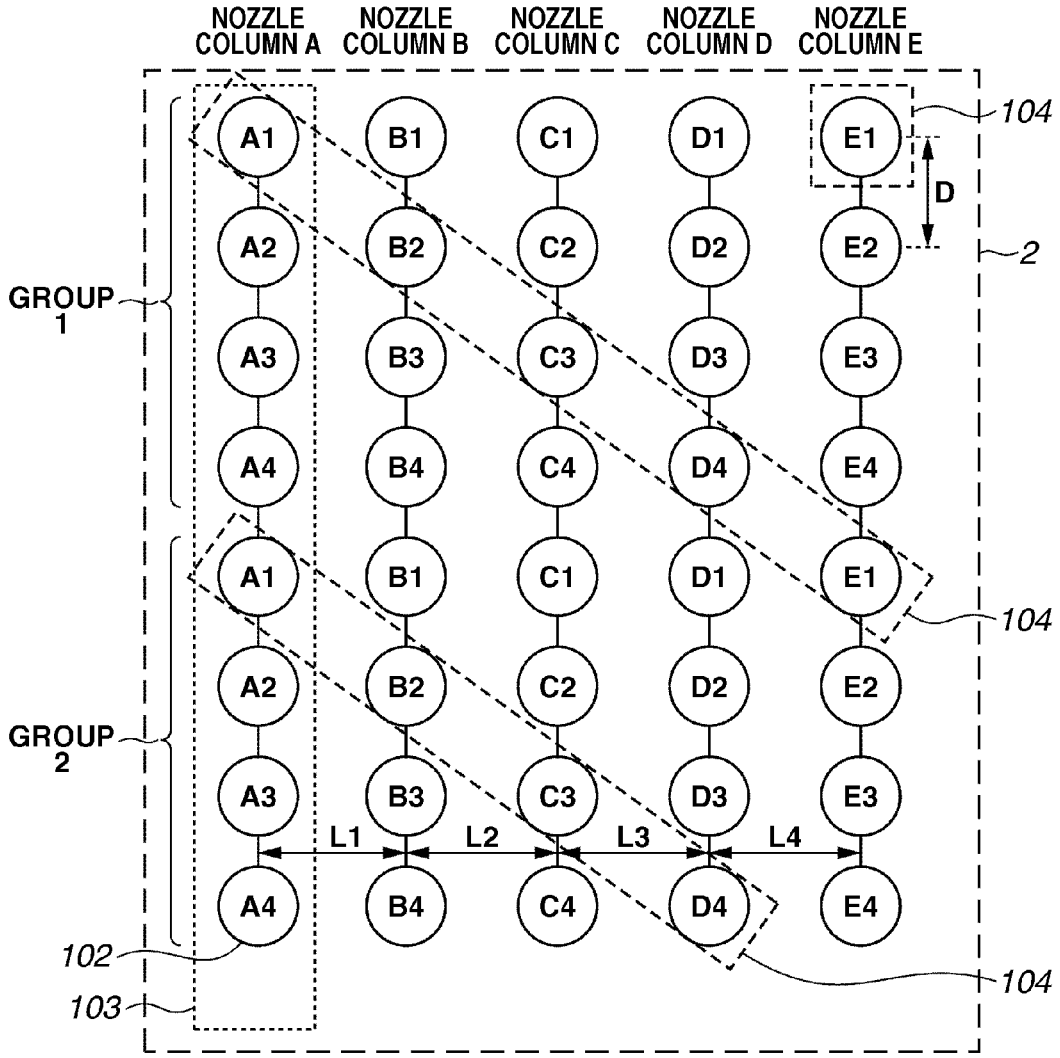
FIG. 8 is a schematic view of a recording head seen from an ink discharge port according to a second exemplary embodiment.
Figure 9:
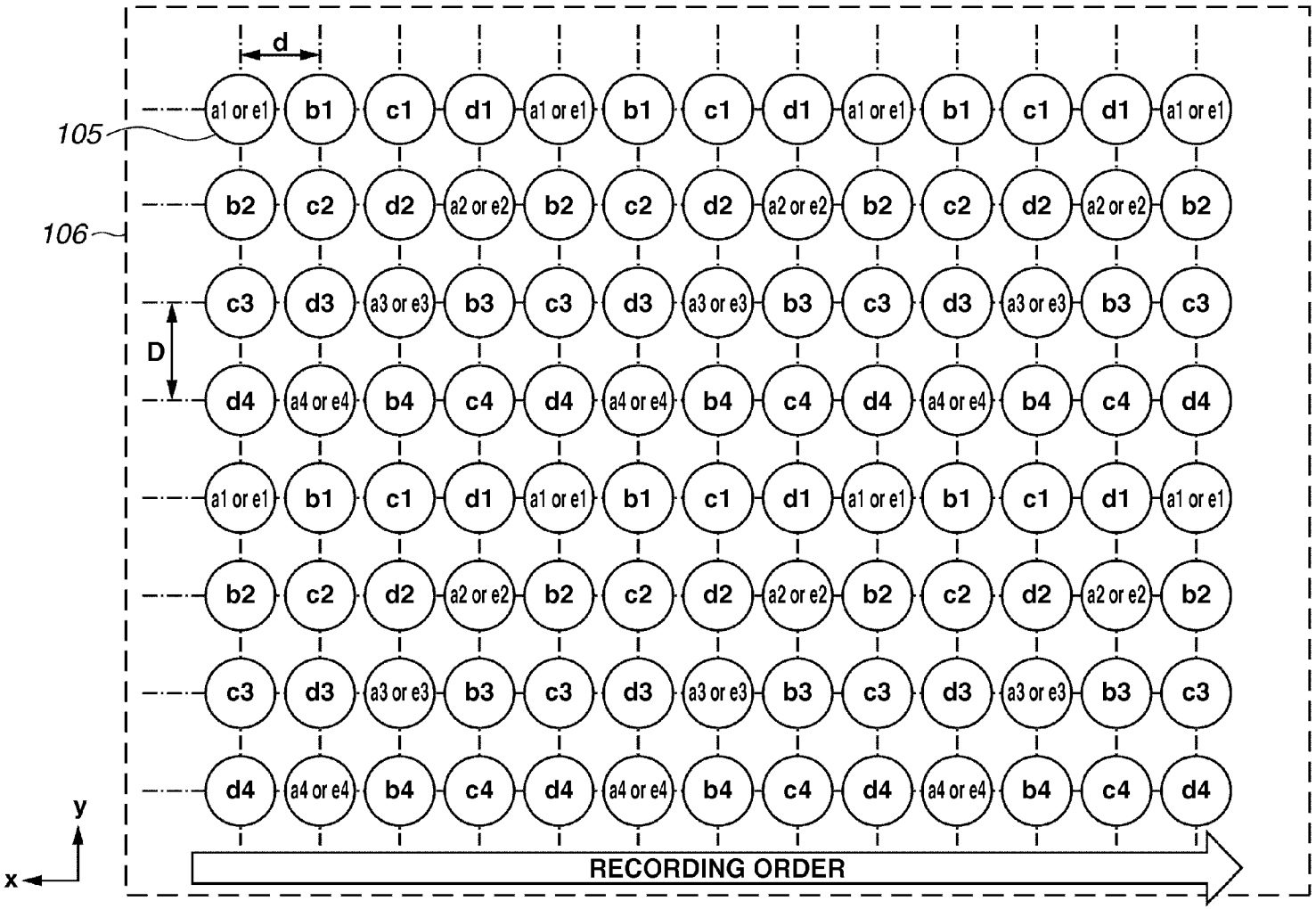
FIG. 9 is a schematic view of a pixel formed on a recording medium by an ink jet recording apparatus according to the second exemplary embodiment.

FIG. 8 is a schematic view of a recording head seen from an ink discharge port according to the second exemplary embodiment. FIG. 9 is a schematic view of a pixel formed on a recording medium 106 by the ink jet recording apparatus according to the second exemplary embodiment.

As illustrated in FIG. 8, a recording head 2 according to the present exemplary embodiment includes five nozzle columns 103 (columns A to E). Each nozzle column 103 includes a plurality of linearly disposed (in-line) recording elements 102.

In the recording head 2 according to the present exemplary embodiment, as in the case of the first exemplary embodiment, the recording elements 102 constituting the nozzle column 103 are divided into a plurality of groups, and block numbers are assigned in order to the recording elements of each group. More specifically, the recording elements 102 of a nozzle column A are respectively blocks A1 to A4, and the recording elements 102 of a nozzle column B are respectively blocks B1 to B4. Similarly, the recording elements 102 of a nozzle column C are respectively blocks C1 to C4, the recording elements 102 of a nozzle column D are respectively blocks D1 to D4, and the recording elements 102 of a nozzle column E are respectively blocks E1 to E4. During recording to the recording medium 106, the recording element 102 is driven by blocks of each nozzle column 103 in time division.

In the recording head according to the present exemplary embodiment, the number of nozzle columns is larger by one than that of recording elements (number of blocks) in the group. The nozzle column E, which is an addition to those of the first exemplary embodiment, is disposed so that arrangement positions of blocks E1 to E4 can match those of blocks A1 to A4 in the raster direction, and recorded data to be printed by the nozzle column A can be allocated to the nozzle column E.

A control apparatus 9 randomly determines which of the nozzle A and the nozzle E is used. A driving method of blocks in the nozzle columns A to E is similar to that of the first exemplary embodiment illustrated in FIGS. 4A to 4D.

If data is recorded by such a method, as illustrated in FIG. 9, pixels 105 formed by the recording element 102 of the nozzle column A or the recording element 102 of the nozzle column E are arranged on the recording medium 106.

As a method for determining the nozzle column to be used by the control apparatus 9, for example, a method for storing a random number generation function beforehand in a memory of the control apparatus 9, and randomly selecting a nozzle column to be used based on a random number generated by the random number generation function can be used.

In addition, a method for installing a random number generation circuit as a nozzle column determination unit beforehand in the control apparatus 9, and randomly selecting a nozzle column to be used based on a random number generated by the random number generation circuit can be also used. Furthermore, a method for storing a random number table created beforehand in the memory of the control apparatus 9, and randomly selecting a nozzle column to be used based on a random number read from the random number table can be used.

As described above, according to the second exemplary embodiment, the blocks A1 and E1 are randomly used in the group 104 including the blocks A1, B2, C3, D4, and E1, and the blocks A2 and E2 are randomly used in the group 104 including the blocks A2, B3, C4, D1, and E2. Similarly, the blocks A3 and E3 are randomly used in the group 104 including the blocks A3, B4, C1, D2, and E3, and the blocks A4 and E4 are randomly used in the group 104 including the blocks A4, B1, C2, D3, and E4. Accordingly, combinations of blocks for forming pixels 105 in the same column of the recording medium 106 are (A1, B2, C3, and D4), (A2, B3, C4, and D1), (A3, B4, C1, and D2), (A4, B1, C2, and D3), (B1, C2, D3, and E4), (B2, C3, C4, and E1), (B3, C4, D1, and E2), and (B4, C1, D2, and E3).

A driving timing of each block in each group 104 will be described referring to the drawings.

Figure 10A:
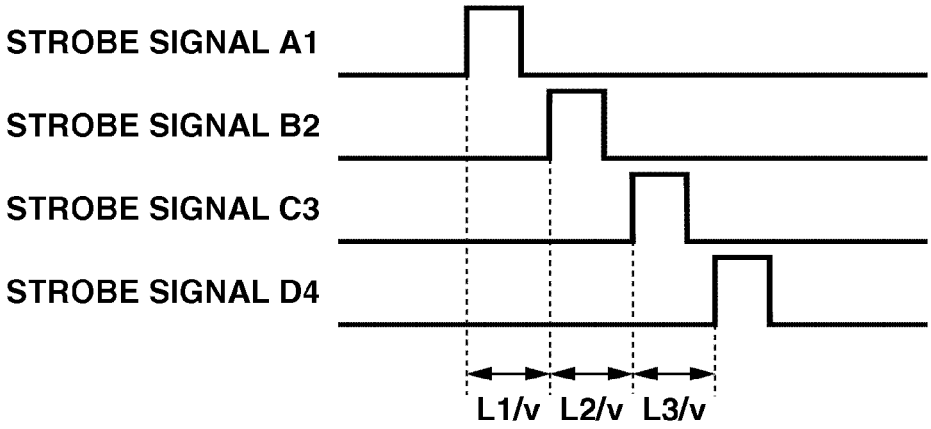
FIGS. 10A and 10B are timing charts of an example of driving timings to match impact positions with one another in a column direction according to the second exemplary embodiment.
Figure 10B:
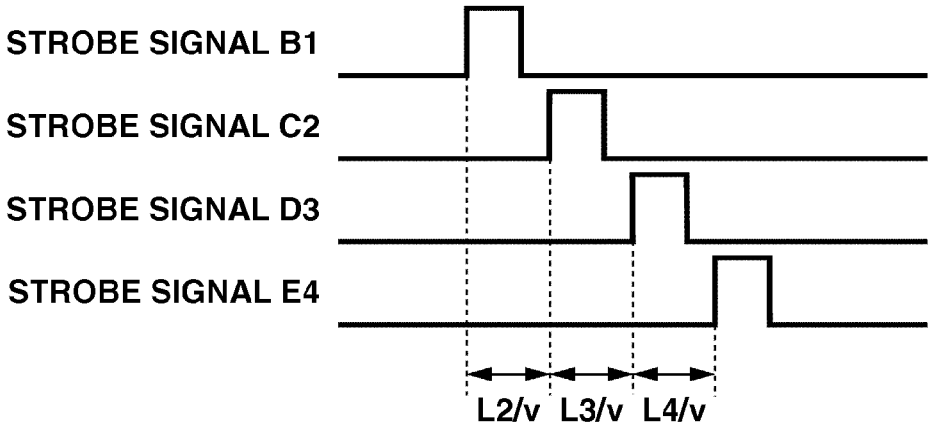

FIGS. 10A and 10B are timing charts illustrating an example of driving timings of the blocks of each group according to the second exemplary embodiment. FIG. 10A illustrates driving timings when the blocks (A1, B2, C3, and D4) are used, and FIG. 10B illustrates driving timings when the blocks (B1, C2, D3, and E4) are used. As illustrated in FIG. 8, a distance L1 is set between the nozzle column A and the nozzle column B, and a distance L2 is set between the nozzle column B and the nozzle column C. A distance L3 is set between the nozzle column C and the nozzle column D, and a distance L4 is set between the nozzle column D and the nozzle column E. As in the case of the first exemplary embodiment, it is presumed that a recording medium 106 is mounted on the conveyance belt 5 to be conveyed at a speed v in an x axis positive direction illustrated in FIG. 9.

When the blocks (A1, B2, C3, and D4) are used, as illustrated in FIG. 10A, a strobe signal B2 is transmitted being delayed by L1/v from transmission time of a strobe signal A1. Similarly, a strobe signal C3 is transmitted being delayed by L2/v from the transmission time of the strobe signal B2, and a strobe signal D4 is transmitted being delayed by L3/v from the transmission time of the strobe signal C3.

In this case, when the transmission time of the strobe signal A1 is zero, and distances between the nozzle columns are L1=L2=L3=L, the transmission time of the strobe signal B2 is represented by L/v, the transmission time of the strobe signal C3 is represented by 2L/v, and the transmission time of the strobe signal D4 is represented by 3L/v.

When the blocks (B1, C2, D3, and E4) are used, as illustrated in FIG. 10B, a strobe signal C2 is transmitted being delayed by L2/v from transmission time of a strobe signal B1. Similarly, a strobe signal D3 is transmitted being delayed by L3/v from transmission time of a strobe signal C2, and a strobe signal E4 is transmitted being delayed by L4/v from transmission time of a strobe signal D3.

In this case, when the transmission time of the strobe signal B1 is zero, and distances between the nozzle columns are L2=L3=L4=L, the transmission time of the strobe signal C2 is represented by L/v, the transmission time of the strobe signal D3 is represented by 2L/v, and the transmission time of the strobe signal E4 is represented by 3L/v.

Thus, by controlling the timing of the strobe signals as in the case of the first exemplary embodiment, forming positions of pixels of recorded data of one column when recording is performed using the plurality of nozzle columns can be matched with one another in the nozzle arrangement direction (column direction) of the recording medium 106.

According to the present exemplary embodiment, the effect similar to that in the first exemplary embodiment can be provided, and use frequencies of the recording elements 102 of the blocks A1 to A4 and the blocks E1 to E4 can be reduced because of the random use of the nozzle column A and the nozzle column E. Thus, endurance time of the recording elements 102 of the blocks A1 to A4 and the blocks E1 to E4 included in the recording head 2 can be extended. Further, the random use of the blocks A1 to A4 or the blocks E1 to E4 allows reduction of image unevenness caused by variation in tolerance of the recording elements 102.

According to the present exemplary embodiment, the configuration of using the nozzle column E in place of the nozzle A is described. However, the recorded data of the nozzle columns B and C can be assigned to the nozzle column E so that the nozzle column E can be used in place of the nozzle columns B and C. In this case, the transmission timing of the strobe signals is appropriately controlled.

Next, an ink jet recording apparatus according to a third exemplary embodiment will be described.

Figures 11A, 11B, 11C:
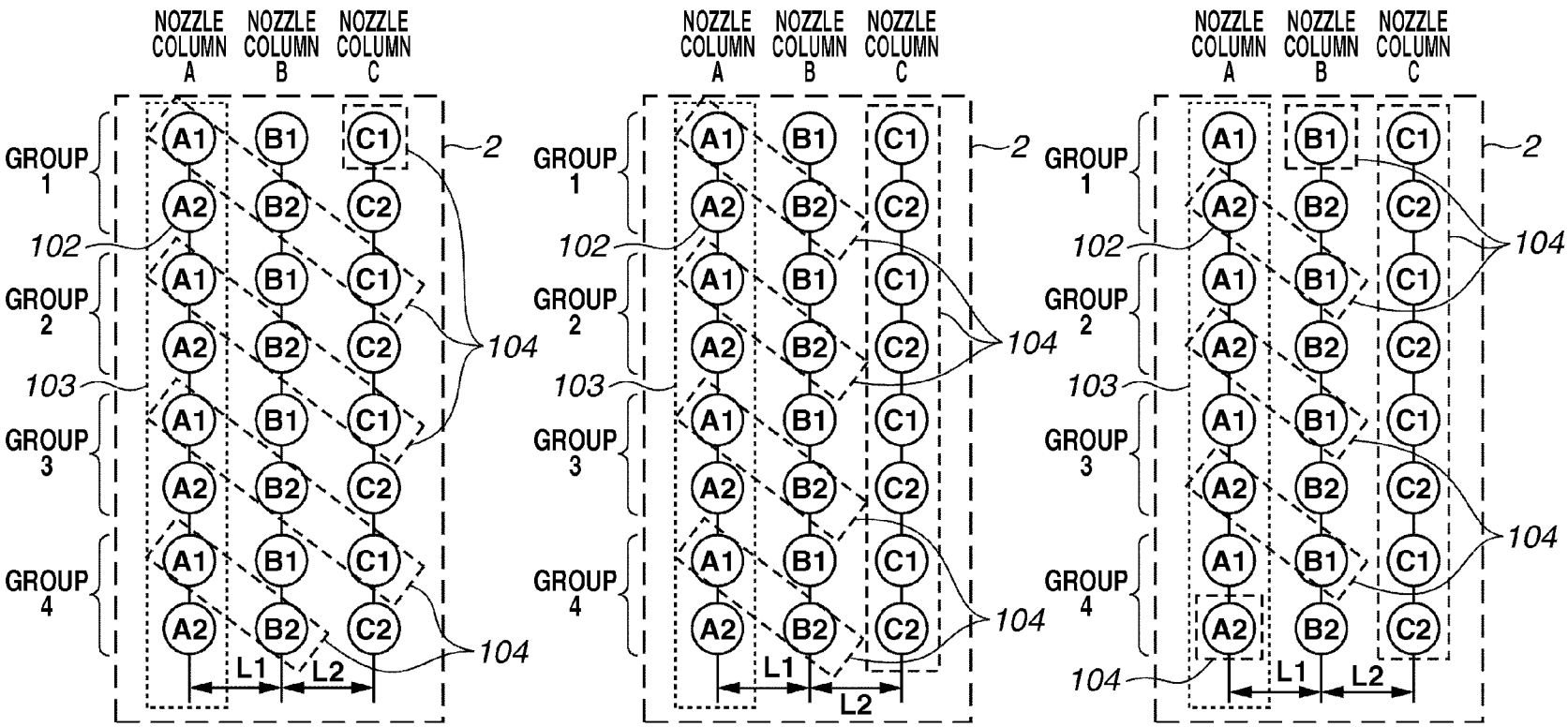
FIGS. 11A to 11C are schematic views of a recording head seen from an ink discharge port according to a third exemplary embodiment.
Figures 12A, 12B, 12C:
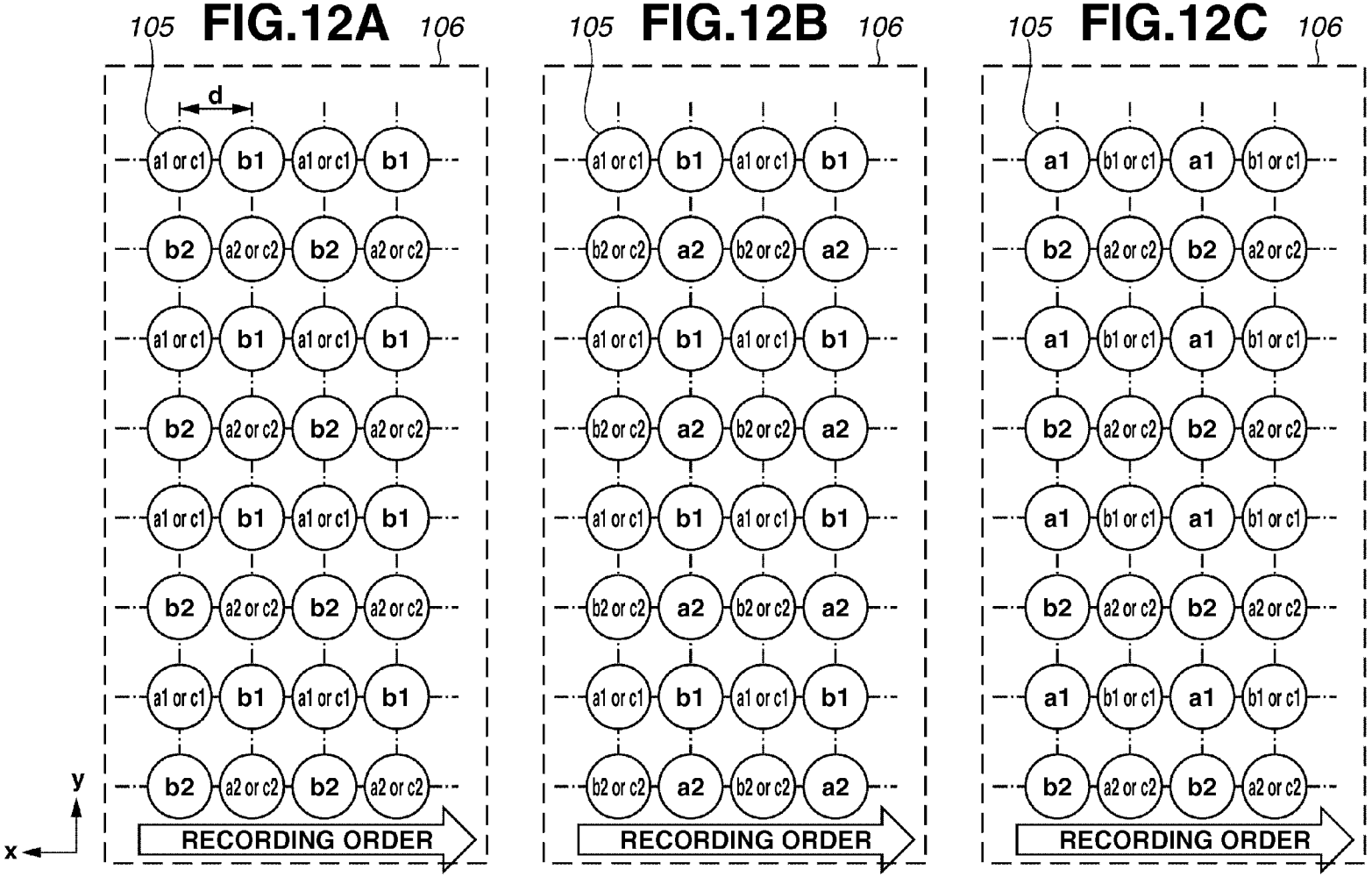
FIGS. 12A to 12C are schematic views of a pixel formed on a recording medium by an ink jet recording apparatus according to the first exemplary embodiment.

The first and second exemplary embodiment are described by way of example where the group includes the four recording elements. However, the present exemplary embodiment will be described by way of example where a group includes two recording elements. FIGS. 11A to 11C are schematic views of a recording head seen from an ink discharge port according to the third exemplary embodiment. FIGS. 12A to 12C are schematic views of a pixel formed on a recording medium by the ink jet recording apparatus according to the third exemplary embodiment.

As illustrated in FIGS. 11A to 11C, a recording head 2 according to the present exemplary embodiment includes three nozzle columns 103 (columns A to C). Each nozzle column 103 includes a plurality of linearly disposed (in-line) recording elements 102.

In the recording head 2 according to the present exemplary embodiment, the nozzle columns 103 are divided into a plurality of groups including two continuous recording elements 102. Block numbers are assigned in order to the recording elements of each group. More specifically, the recording elements 102 of a nozzle column A are respectively blocks A1 and A2, the recording elements 102 of a nozzle column B are respectively blocks B1 and B2, and the recording elements 102 of a nozzle column C are respectively blocks C1 and C2. During recording on the recording medium 106, the recording element 102 is driven by blocks of each nozzle column 103.

In this configuration, as illustrated in FIGS. 11A to 11C, the number of nozzle columns is larger by one than the number of blocks. Accordingly, positions of the blocks A1 and A2 in the nozzle column A and positions of the blocks C1 and C2 in the nozzle column C match each other in a raster direction.

In the arrangement of the recording elements 102 illustrated in FIGS. 11A to 11C, positions of the block B1 and the block C1 match each other in the raster direction, and positions of the block B2 and the block C match each other in the raster direction.

Thus, according to the third exemplary embodiment, data is recorded on the recording medium 106 using one of two recording elements which can form pixels 105 in the same raster. A control apparatus 9 randomly determines which of the two recording elements which can perform recording in the same raster is used. A driving method of each block in the nozzle columns A to C is similar to that of the first exemplary embodiment illustrated in FIGS. 4A to 4D. As a method for randomly selecting blocks to be used by the control apparatus 9, as in the case of the second exemplary embodiment, methods using a random number generation function, a random number generation circuit, and a random number table can be used.

More specifically, as illustrated in FIG. 11A, the blocks A1 and C1 may be randomly used in the group 104 including the blocks A1, B2, and C1, and the blocks A2 and C2 may be randomly used in the group 104 including the blocks A2, B1, and C2. Pixels in the case of such driving are formed as illustrated in FIG. 12A.

As illustrated in FIG. 11B, in the group 104 including the blocks A1, B2, C1, and C2, the blocks A1 and C1 may be randomly used, and also the blocks B2 and C2 may be randomly used. Pixels in the case of such driving are formed as illustrated in FIG. 12B.

As illustrated in FIG. 11C, in the group 104 including the blocks A2, B1, C2, and C1, the blocks A2 and C2 may be randomly used, and also the blocks B2 and C1 may be randomly used. Pixels in the case of such driving are formed as illustrated in FIG. 12C.

Accordingly, combinations of blocks for forming pixels 105 in the same column of the recording medium 106 are A1 and B2, A2 and B1, B1 and C2, B2 and C1, A1 and C2, A2 and C1, and C1 and C2.

A driving timing of each block in each group 104 will be described below. As illustrated in FIGS. 11A to 11C, a distance L1 is set between the nozzle column A and the nozzle column B, and a distance L2 is set between the nozzle column B and the nozzle column C. As in the case of the first and second exemplary embodiments, it is presumed that a recording medium 106 is mounted on a conveyance belt 5 to be conveyed at a speed v in an x axis positive direction illustrated in FIG. 9.

As described above, in the recording head 2 according to the third exemplary embodiment, the recording elements 102 of the nozzle column 103 are arranged in-line. Accordingly, when pixels are formed to match each other in position in the column direction between the blocks A1 and B2, as in the case of the second exemplary embodiment, a strobe signal B2 is transmitted being delayed by L1/v from transmission time of a strobe signal A1. When pixels are formed to match each other in position in the column direction between the blocks A2 and B1, a strobe signal B1 is transmitted being delayed by L1/v from transmission time of a strobe signal A2.

When pixels are formed to match each other in position in the column direction between the blocks B1 and C2, a strobe signal C2 is transmitted being delayed by L2/v from transmission time of a strobe signal B1. When pixels are formed to match each other in position in the column direction between the blocks B2 and C1, a strobe signal C1 is transmitted being delayed by L2/v from transmission time of a strobe signal B2.

When pixels are formed to match each other in position in the column direction between the blocks A1 and C2, the strobe signal C2 is transmitted being delayed by (L1+L2)/v from transmission time of the strobe signal A1. When pixels are formed to match each other in position in the column direction between the blocks A2 and C1, the strobe signal C1 is transmitted being delayed by (L1+L2)/v from transmission time of the strobe signal A2.

Further, when the blocks C1 and C2 are used, the strobe signals C1 and C2 are matched with each other in transmission time.

If recording is performed according to the above-described method, as illustrated in FIGS. 12A to 12C, pixels 105 corresponding to the blocks of A1 and B2, A2 and B1, B1 and C2, B2 and C1, A1 and C2, A2 and C1, and C1 and C2 can be formed in the same column.

According to the present exemplary embodiment, the effect similar to that in the first exemplary embodiment can be provided, and the number of randomly usable recording elements 102 is larger than that in the second exemplary embodiment. If the number of randomly usable recording elements 102 increases, in the conveyance direction of the recording medium 106, the combinations of recording elements 102 to be used for forming pixels 105 are changed more randomly. Thus, image unevenness caused by variation in tolerance of the recording elements 102 can be reduced more than the second exemplary embodiment.

The above-described second and third exemplary embodiments are directed to the configuration example where the number of nozzle columns is larger by one than the number of recording elements included in the group of each nozzle column. However, the number of nozzle columns can be larger by two or more than that of recording elements. For example, when the number of nozzle columns is an integral multiple of that of recording elements, combinations of randomly used recording elements 102 can be set in all the recording elements 102 included in the recording head. Therefore, endurance time of the recording elements 102 can be extended, and image unevenness caused by variation in tolerance of the recording elements 102 can be further reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An ink jet recording method for recording an image on a recording medium using a recording head including a plurality of element arrays, wherein each element array includes a plurality of recording elements that are arrayed in a first direction and used for discharging ink for forming pixels on a recording medium, wherein the plurality of recording elements of each element array are divided into a plurality of groups where each group includes a plurality of recording elements being continuously arranged and assigned to different driving blocks for driving the recording elements, and wherein a number of the element arrays is equal to or larger than a number of recoding elements in a group, the ink jet recording method comprising:

executing relative movement between the recording medium and the recording head in a second direction intersecting the first direction; and controlling the recording head so that the plurality of recording elements in each group of the respective driving blocks are driven in order and at a predetermined time interval between the respective driving blocks, wherein the plurality of element arrays are driven so that pixels, based on recording data for one column extending in the first direction, are recorded by using the plurality of element arrays within an area of the recording medium corresponding to relative movement width of the relative movement in the second direction within the predetermined time interval.

2. The ink jet recording method according to claim 1, wherein the predetermined time interval is represented by L/v, where L is a distance between adjacent element arrays on the recording head and v is a relative movement speed of the relative movement.

3. The ink jet recording method according to claim 1, wherein the plurality of element arrays are arrayed at a specific interval with respect to a direction intersecting the first direction.

4. The ink jet recording method according to claim 1, wherein the plurality of element arrays are used for discharging a same type of inks.

5. The ink jet recording method according to claim 1, wherein the ink jet recording apparatus includes a plurality of recording heads.

6. The ink jet recording method according to claim 1, wherein the recording head is a line head provided with the recording elements in a region over a length of the recording medium in the first direction.

7. The ink jet recording method according to claim 1, wherein the recording element is a heater for generating thermal energy used for discharging ink.

8. The ink jet recording method according to claim 1, wherein the recording head is controlled so that an order of driving the plurality of recording elements in each group is same for all the plurality of element arrays with respect to the first direction.

9. The ink jet recording method according to claim 1, wherein the number of element arrays is larger than the number of recording elements in a group, the ink jet recording method further comprising determining which element array of the element arrays is used for the recording.

10. The ink jet recording method according to claim 1, wherein the number of the element arrays is equal to the number of recoding elements in the group.

11. The ink jet recording method according to claim 1, wherein the number of the element arrays is larger than the number of recoding elements in the group.

12. The ink jet recording method according to claim 1, wherein the plurality of element arrays are driven so that, based on recording data for a first column extending in the first direction, a pixel is recorded by using a first recording element in a predetermined group and so that, based on recording data for a second column extending in the first direction adjacent to the first column in the second direction, a pixel is recorded by using a second recording element driven next to the first recording element in the predetermined group.

13. The ink jet recording method according to claim 1, wherein the predetermined time interval is represented by d/v, where d is a distance between adjacent columns on the recording medium in the second direction and v is a relative movement speed of the relative movement.

14. An ink jet recording method for recording an image on a recording medium using a recording head including a plurality of element arrays, wherein each element array includes a plurality of recording elements that are arrayed in a first direction and used for discharging ink for forming pixels on a recording medium, wherein the plurality of recording elements of each element array are divided into a plurality of groups where each group includes a plurality of recording elements being continuously arranged and assigned to different driving blocks for driving the recording elements, and wherein a number of the element arrays is equal to or larger than a number of recoding elements in a group, the ink jet recording method comprising:

executing relative movement between the recording medium and the recording head in a second direction intersecting the first direction; and controlling the recording head so that the plurality of recording elements in each group of the respective driving blocks are driven in order and at a predetermined time interval between the respective driving blocks, wherein the plurality of element arrays are driven so that the recording head is capable of recording pixels based on recording data for one column extending in the first direction by the plurality of element arrays within an area of the recording medium corresponding to relative movement width of the relative movement in the second direction within the predetermined time interval.

15. The ink jet recording method according to claim 14, wherein the plurality of element arrays are used for discharging a same type of inks.

16. The ink jet recording method according to claim 14, wherein the predetermined time interval is represented by d/v, where d is a distance between adjacent element arrays on the recording medium in the second direction and v is a relative movement speed of the relative movement.

17. The ink jet recording method according to claim 14, wherein the controlling is performed so that the plurality of recording elements are driven by generating driving signals used for driving the plurality of recording elements in each group.

18. An ink jet recording method for recording an image on a recording medium using a recording head including a plurality of element arrays, wherein each element array includes a plurality of recording elements that are arrayed in a first direction and used for discharging ink for forming pixels on a recording medium, wherein the plurality of recording elements of each element array are divided into a plurality of groups where each group includes a plurality of recording elements being continuously arranged and assigned to different driving blocks for driving the recording elements, and wherein a number of the element arrays is equal to or larger than a number of recoding elements in a group, the ink jet recording method comprising:

executing relative movement between the recording medium and the recording head in a second direction intersecting the first direction; and controlling the recording head so that the plurality of recording elements in each group of the respective driving blocks are driven in order and at a predetermined time interval between the respective driving blocks, wherein the plurality of element arrays are driven so that the recording head is capable of recording pixels based on recording data for a first column extending in the first direction using first recording elements assigned to a first driving block of the respective driving blocks in predetermined groups of each of the plurality of element arrays, and is capable of recording pixels based on recording data for a second column extending in the first direction adjacent to the first column in the second direction using a second recording element assigned to a second driving block other than the first driving block used for printing for the recording data for the first column, in the predetermined groups of each of the plurality of element arrays.

19. A recording head comprising:

a substrate;

a plurality of element arrays used for discharging ink, wherein each element array includes a plurality of recording elements that are arrayed in a first direction on the substrate;

a driving unit on the substrate configured to drive the plurality of recording elements in each of the plurality of element arrays such that the plurality of recording elements of each element array are divided into a plurality of groups where each group includes a plurality of recording elements being continuously arranged and assigned to different driving blocks for driving the recording elements, wherein a number of the element arrays is equal to or larger than a number of recoding elements in a group.

20. The recording head according to claim 19, wherein the driving unit includes a driving circuit.

* * * * *